US006202587B1

(12) United States Patent
Stewart

(10) Patent No.: US 6,202,587 B1
(45) Date of Patent: Mar. 20, 2001

(54) METHOD AND APPARATUS FOR WARNING INDIVIDUALS OF UNSAFE ZONES

(75) Inventor: Brian G. Stewart, Howell, MI (US)

(73) Assignee: Jervis B. Webb International Company, Farmington Hills, MI (US)

( * ) Notice: Subject to any disclaimer, the term of this patent is extended or adjusted under 35 U.S.C. 154(b) by 0 days.

(21) Appl. No.: 09/192,292

(22) Filed: Nov. 16, 1998

(51) Int. Cl.[7] ..... G08B 6/00; G08B 21/22

(52) U.S. Cl. ..... 116/205; 116/201; 116/209; 116/DIG. 17; 40/608; 340/908.1; 340/908; 340/573; 340/679

(58) Field of Search ..... 116/205, 209, 116/DIG. 15, DIG. 17, 200, 201; 40/608; 52/174, 180, 181; 340/908.1, 908, 573, 679, 680, 685

(56) References Cited

U.S. PATENT DOCUMENTS

| | | | | |
|---|---|---|---|---|
| 2,174,716 | | 10/1939 | Bethell | 472/90 |
| 2,333,273 | * | 11/1943 | Scanlon | 116/209 |
| 2,774,323 | | 12/1956 | Kirk | 116/63 P |
| 2,783,730 | | 3/1957 | Robins | 116/63 R |
| 3,693,940 | | 9/1972 | Kendall et al. . | |
| 4,068,339 | * | 1/1978 | Maruyama et al. | 52/180 |
| 4,080,087 | | 3/1978 | Phillips | 404/72 |
| 4,090,465 | * | 5/1978 | Bell, Sr. | 40/608 |
| 4,515,499 | | 5/1985 | Furiate | 404/6 |
| 4,542,709 | | 9/1985 | Spaugh | 116/63 P |
| 4,571,118 | | 2/1986 | Schmanski | 404/10 |
| 4,620,816 | * | 11/1986 | Kupfer | 52/174 |
| 4,645,168 | | 2/1987 | Beard | 248/548 |
| 4,715,743 | | 12/1987 | Schmanski | 404/9 |
| 4,750,450 | * | 6/1988 | Wiegand | 116/205 |
| 5,040,478 | * | 8/1991 | Hughes | 116/209 |
| 5,277,146 | * | 1/1994 | Hughes, Jr. | 40/608 |
| 5,303,669 | * | 4/1994 | Szekely | 116/205 |
| 5,322,226 | | 6/1994 | Kranefeld . | |
| 5,328,293 | | 7/1994 | Keefe | 404/9 |
| 5,374,137 | | 12/1994 | Steinberg | 404/9 |
| 5,474,016 | * | 12/1995 | Haney | 52/174 |
| 5,775,835 | * | 7/1998 | Szekely | 116/205 |
| 6,025,773 | * | 2/2000 | Bresnan | 116/205 |

FOREIGN PATENT DOCUMENTS

| | | | |
|---|---|---|---|
| 2 613 393 A1 | | 10/1988 | (FR) . |
| 2 201 686 | | 9/1988 | (GB) . |
| 0040956 | * | 4/1978 | (JP) . |

* cited by examiner

*Primary Examiner*—Diego Gutierrez
*Assistant Examiner*—Stanley J. Pruchnic, Jr.
(74) *Attorney, Agent, or Firm*—Dickinson Wright PLLC

(57) ABSTRACT

A system and method for warning an individual of entry into an unsafe zone, particularly one that includes a floor or overhead conveyor, comprises a plurality of flexible upright members. The members are arranged to cover or affront the unsafe zone and are at a height so that an individual will contact and deform the members. Such contact then warns the individual that he or she is entering or approaching an unsafe zone. The flexible upright members can be arranged in separable or integral fashion on one or more bases. When using a plurality of bases, the bases can be sized and arranged to cover or abut any configuration of an unsafe zone.

23 Claims, 2 Drawing Sheets

METHOD AND APPARATUS FOR WARNING INDIVIDUALS OF UNSAFE ZONES

FIELD OF THE INVENTION

The present invention is directed to a method and an apparatus for warning individuals of the existence of one or more unsafe zones, and, in particular, to a system and method which employs flexible upright members in a distribution pattern that warn individuals of entry into or proximity to an unsafe zone from any direction of entry.

BACKGROUND ART

In the prior art, various methodologies, devices and apparatus have been proposed for safety or warning purposes. Often times, an area deemed to be unsafe is surrounded by barriers such as ropes, barricades or the like to prevent individuals from entering the area. In other instances, signs or other indicia are employed to visually warn individuals of danger. Audio signals may also be utilized where appropriate.

One particular problem concerning unsafe zones is the fact that individuals may still have to travel through the unsafe zone, despite the imminent danger that may exist. In these instances, barriers such as fencing, ropes or the like are not practical since they would impede an individual's movement through the area. Signs or other visual indicators may also be insufficient if an individual, for whatever reason, does not see the sign, and is therefore not aware that he or she is passing through an unsafe or dangerous zone. This problem is particularly pervasive in vicinities employing floor or overhead conveyors. In these instances, an individual may have to pass beneath the overhead conveyor track, the area beneath qualifying as an unsafe zone should the conveyor and its cargo be traveling therethrough. In addition, a floor conveyor presents areas of hazardous pinch points between the product being moved and the stationary conveyor.

In light of the dangers and disadvantages noted above, a need exists for improved ways to warn individuals that they are entering or nearing an unsafe zone. In a response to this need, the present invention provides both a method and an apparatus to prevent accidental injury to an individual by warning the individual that he or she is entering or nearing an unsafe zone. The present invention accomplishes this aim through the use of a forest or distribution of upright flexible members. The members are arranged in or near the unsafe zone so that an individual entering or approaching the unsafe zone from any direction would contact and trample the flexible upright members. Each upright member can be oriented in different directions so that warning verbage or indicia can be seen from any approach. Contact between the members and the individual alerts the individual that he or she has entered an unsafe area, particularly if the individual may not realize it visually.

Flexible upright members alone are not unique. U.S. Pat. No. 4,645,168 to Beard discloses a traffic marker support comprising a base and an upright member. The marker of Beard is designed for use as a highway marker along a roadside. U.S. Pat. No. 4,515,499 to Furiate discloses traffic lane delineators which are arranged in a row to separate lanes, prevent passing or the like.

U.S. Pat. No. 4,571,118 to Schmanski discloses simulated tubular highway safety devices which can deflect on impact. While these patents disclose upright markers which may be flexible, none teach or suggest a safety forest of markers to warn individuals of an unsafe or dangerous zone.

Walkways having raised protrusions or humps have been proposed to aid blind or visually handicapped persons. U.S. Pat. No. 4,080,087 to Phillips discloses such a walkway. Another aid for the visually handicapped is disclosed in U.S. Pat. No. 4,715,743 to Schmanski. Neither of these patents disclose a distribution of upright flexible members which are designed to be trampled upon so as to warn an individual of an unsafe zone.

SUMMARY OF THE INVENTION

Accordingly, it is a first object of the present invention to provide an improved manner of warning individuals of an unsafe zone.

Another object of the present invention is to provide a warning method and apparatus which warns while not impeding an individual's movement.

A still further object of the present invention is to provide a warning method and apparatus especially suited for vicinities employing floor and/or overhead conveyor systems.

One other object of the present invention is a warning apparatus that can be readily tailored to the geometry of an unsafe zone.

One additional object is a method and apparatus that can be readily moved from one area to another for instances where only temporary warnings are needed.

Yet another object is a method and apparatus that links the operation of machinery such as a conveyor to entry into the warning zone, such entry disabling the machinery.

Other objects and advantages of the present invention will become apparent as a description thereof proceeds.

In satisfaction of the foregoing objects and advantages, the present invention provides both a method and an apparatus for warning individuals of an unsafe area or a zone. In the method aspect of the invention, the unsafe area is first identified. Once identified, a plurality of members having an elongated shape are arranged to cover or affront the unsafe area. The members are resilient so that they regain their elongated shape after being deformed and are of such a length that an individual can sense entering the unsafe area by contact between the individual and a portion of one of the members.

The method is particularly adapted for areas beneath overhead conveyors and pinch points of floor mounted conveyors, but can also be placed in other unsafe areas such those areas affronting machinery, a hazardous-material containing site, a dangerous intersection or the like.

In the apparatus aspect of the invention, a system is provided which combines the plurality of members of elongated shape and at least one base. The base is arranged to cover or affront an unsafe area so as to distribute the members in a manner that warns an individual entering or affronting the unsafe area. The members are sized and linked so that contact occurs between at least one of the members and an individual to provide positive warning of the unsafe area.

The members can be supported by a number of bases rather than a single base. In this embodiment, the bases can have the same shape or have a one or more different shapes. The bases can have varying peripheral outlines to accommodate differently-shaped unsafe areas. For example, squares, rectangles, triangles and the like can be combined to cover areas that are not square or rectangular in shape.

In addition, a thick rubber mat with pre-cut slots of different or the same orientations can be employed. The mat can be laid and cut like a carpet to surround the unsafe zone or obstacle. After laying the mat, the members can be inserted in the slots. In this way, areas can be custom fitted leaving no exposed unsafe areas, especially around contours of the unsafe zone. Alternatively, the members can be first attached or secured to the mat followed by mat trimming.

The members and the one or more bases can be integrally attached as a one piece assembly or can be made separable. In addition, the number of members associated with a particular base can vary so that the density of the members can vary when arranged with a particular unsafe area. The change in density of the members can be used to provide another level of warning once an individual is within the distribution of elongated and flexible members.

The flexible members can have different cross-sectional shapes, and can include indicia or coloring to provide additional warning to individuals.

BRIEF DESCRIPTION OF THE DRAWINGS

Reference is now made to the drawings of the invention wherein.

DESCRIPTION OF THE PREFERRED EMBODIMENTS

Figure 1:
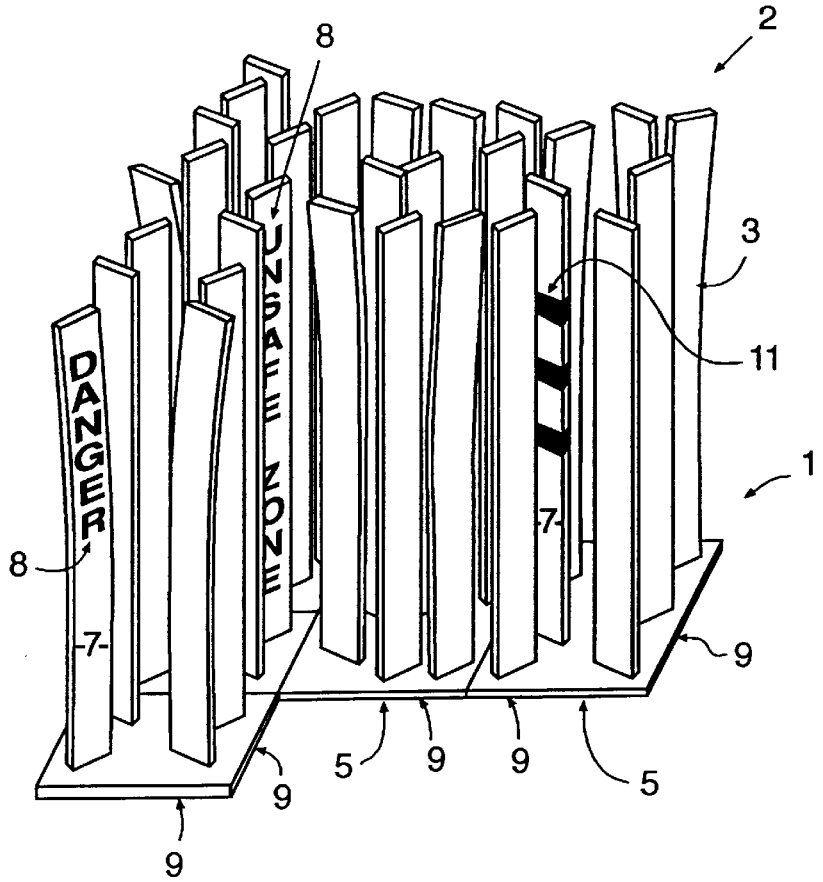
FIG. 1 is a perspective view of a first embodiment of the invention.

With reference to FIG. 1, an exemplary apparatus representing the invention is generally designated by the reference numeral 2. The apparatus includes a plurality of segments 1, each segment made up of a base 5 and a plurality of flexible members 3 extending from each base 5. Each member 3 is in the form of a slat having a generally rectangular (transverse cross) sectional shape and being flexible or resilient in nature. Each member 3 has opposing faces 7. One or both faces 7 can be adapted to display warning terms 8 such as "danger" or "unsafe zone." Markings 11 can also be employed on the faces 7. Bright colors, e.g., safety orange or yellow, can also be utilized to facilitate warning an individual of the approach or entry into an unsafe zone.

In FIG. 1, the unsafe zone is marked or covered by the arrangement of the bases 5. In other words, the exposed peripheral edges 9 of the bases 5 form an outline which can coincide with the outline of an unsafe zone. The unsafe zone is intended to encompass both an area where the individual is in danger when he or she is in the area; or an area which affronts or abuts a dangerous zone. When the members and bases abut a dangerous zone, they provide a warning to the individual that a dangerous or unsafe zone lies ahead.

Each base 5 can be the same shape. However, differently-shaped bases can be combined to cover the desired unsafe zone.

Figure 2A:
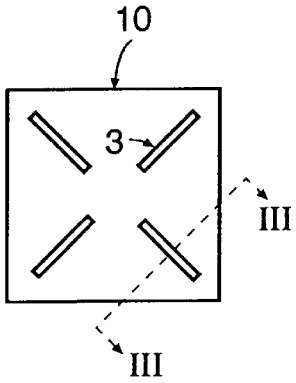
FIGS. 2A–2D show plan views of different base configurations for the invention.
Figure 2B:
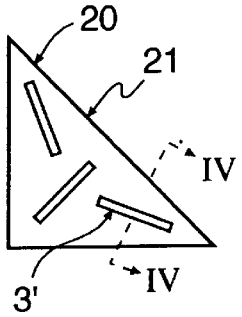
Figure 2C:
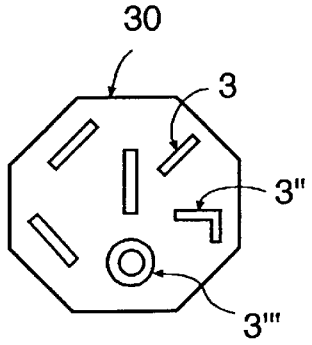

FIGS. 2A–2C show three exemplary base shapes, a square base 10 in FIG. 2A, a triangular base 20 in FIG. 2B and an octagonal base 30 in FIG. 2C. The bases 10 and 20 could be combined to cover unsafe zones which may require the use of the hypotenuse 21 of the triangular base 20. The octagonal base 30 could also be used, either alone or in combination with the square, or other shapes such as rectangular, trapezoidal or the like. In fact, almost any polygonal shape could be employed, either as a group of the same shaped bases or different shapes together to outline a given unsafe zone. Bases could also employ arcuate peripheries (circles) or peripheral portions to accommodate irregularly-shaped unsafe zones.

Figure 2D:
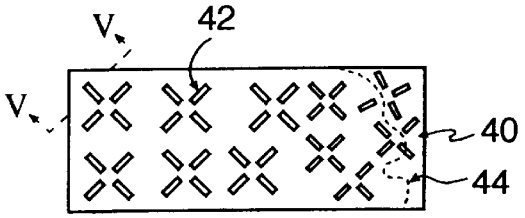

In another embodiment, the base 5 can be made of a resilient material, e.g., a rubber mat. Referring to FIG. 2D, a single rubber mat 40 is depicted with a plurality of slots 42 cut into it to receive the members as described below. Of course, a number of rubber mats could also be employed for unsafe zone warning.

Figure 3A:
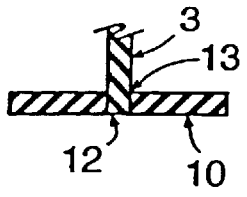
FIG. 3A is a sectional view through the line III—III of FIG. 2A.

The flexible upright members 3 can be attached to the bases 5 in any number of ways. Referring to FIGS. 2A and 3A, the end 12 of the member 3 engages a slot 13 in the base 10. The engagement between the end 12 and 13 can be made removable so that one or more of the upright members 3 can be removed from the base 10 if so desired. Alternatively, an integral connection can be made where the end 12 is permanently fastened in the slot 13, e.g., through the use of adhesives or by molding the base and flexible member as a one piece unit.

Figure 3B:
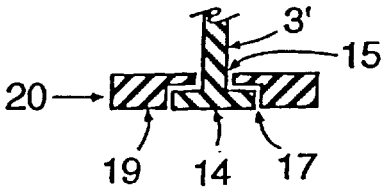
FIG. 3B is a sectional view through the line IV—IV of FIG. 2B.

Another form of attachment is disclosed in FIGS. 2B and 3B. In this embodiment, the flexible member 3' has its own base 14 which cooperates with a recess 17 in an underside 19 of the base 20. To connect the base 20 to the flexible upright member 3', the free end (not shown in FIG. 3B) of the upright member 3' would be inserted through slot 15 from the underside 19 of the base 20. The member 3' can be removable or permanently fastened to the base 20.

Referring to FIG. 2C, other cross-sectional configurations for the members 3 of FIG. 1 can be utilized. For example, an L-shaped cross-sectional configuration 3" can be used either in conjunction with other L-shaped members or with different shapes such as the rectangular cross-sectional members 3. A flexible tubular shape 3'" can also be employed.

Figure 3C:
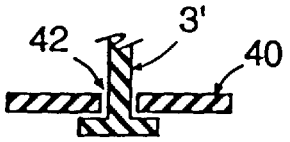
FIG. 3C is a sectional view through the line V—V of FIG. 2D.

FIG. 3C shows the engagement between the member 3' and the resilient mat 40. With the mat having the pre-cut slots 42, the mat can be laid down to cover a particular area. If needed, the mat can be trimmed to custom fit the mat to the area. With the mat laid generally in place, the members 3' can be inserted or pushed through the slots 42 by raising portions of the mat 40 to create the warning apparatus 10. By making the mat 40 of a material that can be trimmed, the mat 40 can accommodate any unsafe zone, e.g., be contoured around sharp corners, undulating perimeters and the like. An exemplary contour that could be formed in the is mat 40 is shown as a hatched line 44 in FIG. 2D. The slots 42 in the mat 40 can also be randomly located or arranged in a pattern.

FIGS. 2A–2D also illustrate a variable density feature of the inventive apparatus. That is, bases, being either identical or differently-shaped, can be linked with a different number of upright members. Thus, the density of the upright flexible members 3 can be varied in a given unsafe zone. More particularly, it may be desirable to alert an individual that one area of an unsafe zone is more dangerous than another area. The area of more danger could include a higher density distribution of the flexible members 3 so that an individual going from a less dense to a more dense zone will sense the change in density and be particularly alert. The density variation can be achieved by combining different bases or removing members from certain bases. For example, referring to FIG. 2B, two of the bases 20 could be combined to form a square with six upright members. A plurality of these bases could be arranged adjacent a plurality of the square bases 10 (four upright members 3) shown in FIG. 2A to create two zones having different densities of upright members. Another example would be to use removable members and vary the number of members per base by removing select members in select areas of a given unsafe zone. With the mat shown in FIG. 2D, only selected slots 42 can be used to retain the members 3' to achieve a variable density. Other density variations as would be within the skill of the art could also be employed.

The height of the various members depicted in FIGS. 2A–2D and 3A–3C can vary within a selected unsafe zone as well. For example, the outer or peripheral portions of a member-containing base could employ taller members than an inner or central portion. Alternatively, the height could increase from one side of a base to the other side in a graduated fashion. Other height variations can be utilized. The members could also track the incline or decline of an adjacent conveyor.

The bases 5 shown in FIG. 1 could be permanently attached to the floor with adhesives or the other fastening means (nails, crews, etc.). Alternatively, the base could be made of a material having sufficient mass to stay in place once set in a given unsafe zone, e.g., a thick rubber mat-like material. In yet another alternative, the base could be made of wood or metal.

The flexible upright members 3 can be made of any material that is resilient enough to flex when contacted by an individual entering an unsafe zone. The upright member should have sufficient rigidity to remain upright until trampled or otherwise deformed by an individual. The material should also have sufficient elasticity so that it regains its upright orientation once contact with an individual is terminated. The height of the member 3 can vary, although the height should be sufficient that some bending or deformation along the member's longitudinal axis is achieved. The bending further accentuates the contact between the individual and the member. Exemplary heights range from 1 to 3 feet, while other heights may be selected. Density levels can range from 1–4 members per square foot to higher levels depending on the member configuration.

Figure 4:
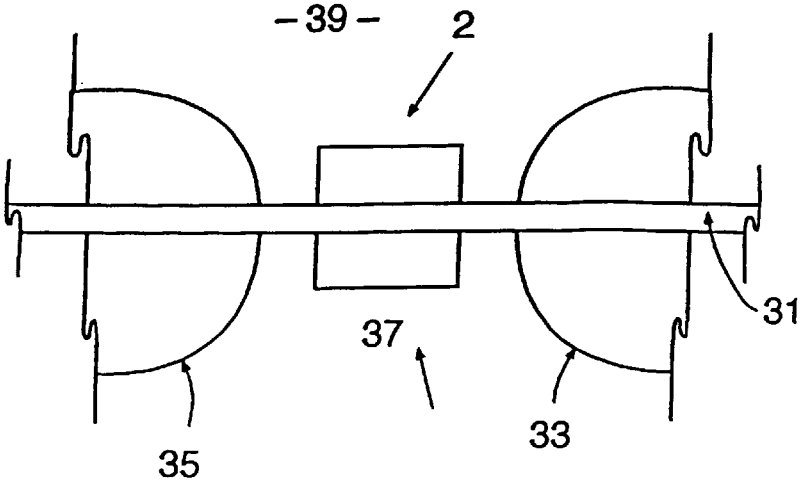
FIG. 4 illustrates a plan view of an exemplary use of the FIG. 1 embodiment.

FIG. 4 shows an exemplary use of the inventive apparatus in the vicinity of an overhead conveyor. The plan view depicted in FIG. 4 shows a conveyor track 31 traveling above a pair of structures 33 and 35. The path 37 between the structures 33 and 35 can be considered an unsafe zone in the vicinity beneath the conveyor track 31. Given the placement of the structures 33 and 35, an individual has no choice but to travel beneath the conveyor track 31 to reach the area 39. The warning apparatus 2 can be placed beneath the conveyor track 31 so that an individual going through the path 37 to the area 39 will have to pass through the warning apparatus 2 so as to alert the individual that he or she is in an unsafe zone.

Figure 5:
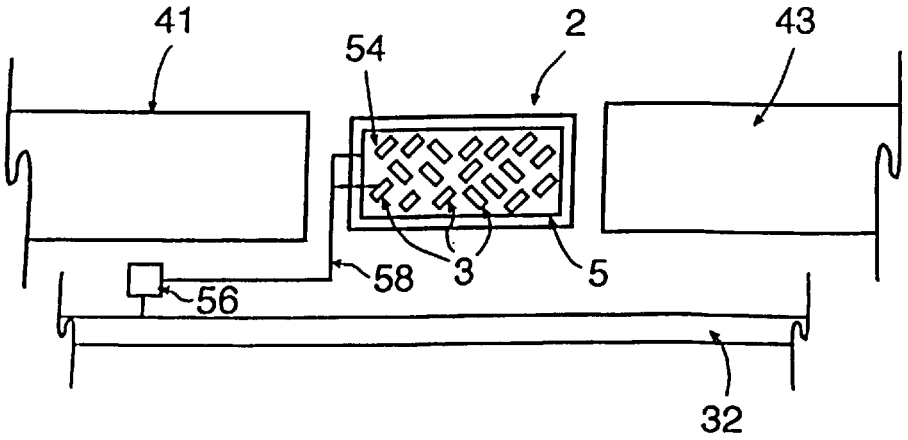
FIG. 5 illustrates another plan view use of the FIG. 1 embodiment.

The warning apparatus 2 could also be used to warn an individual that danger lies ahead. In the plan view of FIG. 5, the warning apparatus 2 alerts an individual that passing between the structures 41 and 43 may cause injury by virtue of the existence of a floor conveyor system 32. In this instance, the unsafe zone is considered to be the area affronting or abutting the floor conveyor system 32 rather than the area directly beneath a conveyor as in FIG. 4. In the FIG. 5 use, the pinch points that are normally associated with floor-level conveyors, e.g., rollers, areas where a moving part such as a belt may coincide with or be near a stationary structures, etc., can be a source of injury, thus qualifying as unsafe zones that benefit from the inventive apparatus and method.

The warning zone apparatus 2 can be placed virtually in any location which presents a potential danger to an individual passing through or passing nearby. In either instance, the individual is alerted by, at the very least, contact with the upright members via the individual's lower limbs that the individual should be alert as to his or her surroundings. With the inventive apparatus and method, the individual will be warned via the contact with the members even if the individual does not visually realize that he or she is about to enter or is entering an unsafe zone.

The length of the upright members 3 should be sufficient so that more than just the bottom of an individual shoes would sense the existence of the forest of members. In this way, a positive contact is made between the individual and the forest to assure that a warning sensation is provided to the individual. Small bumps situated on the floor may not alert an individual, particularly if the floor in general may be uneven to prevent slipping or the like. The height of the vertical members also causes them to be trampled or deformed when an individual enters 15 the unsafe zone. With the length of the members, the trampling requires an individual to step on the trampled upright members and be put off balance to a certain degree if the individual continues to walk through the forest of members. This off balance effect further assures that a warning has been provided to the individual.

In another embodiment, the plurality of bases can be replaced with a single base. When using a single base, the base may be laid or rolled out to cover the unsafe zone and the members can then be attached thereto to form the safety forest for warning individuals. In another mode, the base could already have the members attached thereto, whereby arranging the base to occupy the unsafe zone completes the installation of the inventive apparatus.

Referring again to FIG. 5, the base or one or more of the members could be configured to disable the conveyor 32 or other adjacent machinery upon contact by an individual. For example, the base 5 could have a contact switch 54 placed beneath it such that the switch 54 is tripped when an individual steps on the base. The switch would link to a control 56 or other operating feature of the conveyor 32 via line 58 to disable it. Similarly, one or more of the members 3 could have a switch that could disable the conveyor 32, the switch being operative on contact with an individual or by bending or deforming of one or more of the members 3. Any type of switch or other disabling means to stop the conveyor from operating can be associated with either the base 5 or one or more members 3 so that the warning apparatus functions in a dual role capacity, both warning an individual of the unsafe zone and disabling adjacent machinery.

The use of a single mat also permits the mat to be used in a temporary manner in one location and then moved to another location for warning purposes. In this use, the mat 40 can be merely picked up and transported to another location with minimal effort and time consumption.

Given the number of potential or actual injuries that occur with moving parts of machinery, the inventive method and apparatus provides a cost effective and efficient way of warning individuals of the dangers of an area without unduly impeding an individual's movement.

As such, an invention has been disclosed in terms of preferred embodiments thereof which fulfills each and every one of the objects of the present invention as set forth above and provides new and improved apparatus and method for warning individuals of the existence of an unsafe zone.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A method of warning an individual of an unsafe zone comprising:

a) identifying an unsafe zone;

b) providing a plurality of members, each of said members having an elongated shape and being resiliently flexible so as to regain said elongated shape after being deformed; and c) warning the individual by arranging said plurality of members to cover the unsafe zone and selecting the length of each member such that an individual can sense entering the unsafe zone by contact between a body part of the individual and at least a portion of the plurality of members.

2. The method of claim 1 wherein the unsafe zone is one of a zone beneath an overhead conveyor travel path, a zone adjacent a floor conveyor travel path, a zone affronting machinery, and a zone affronting a hazardous-material containing site.

3. The method of claim 1 further comprising the step of providing at least one base to support the plurality of members.

4. The method of claim 3 comprising providing a plurality of bases, the bases being shaped to arrange the plurality of members cover one of an irregularly-shaped and a regularly-shaped unsafe zone.

5. The method of claim 4 wherein each base has a polygonal periphery so that adjacent bases abut to substantially cover the unsafe zone.

6. The method of claim 3 wherein the method comprises trimming said at least one base to fit the unsafe zone.

7. The method of claim 1 wherein the unsafe zone has one of an irregular shape and a regular shape.

8. The method of claim 1 wherein each member is sufficiently flexible such that each member can be bent from an at rest upright position by said contact.

9. The method of claim 1 wherein lengths of the plurality of members vary.

10. The method of claim 1 wherein the method comprises the additional step of disabling machinery in or adjacent the unsafe zone based upon contact between the individual and at least one of said members.

11. A warning system for alerting an individual to an unsafe zone comprising:

a) a plurality of members, each of said members having an elongated shape and being flexibly resilient so as to regain said elongated shape after being deformed; and b) at least one base, said at least one base supporting at least a portion of said plurality of members;

c) wherein said at least one base is arranged to substantially cover the unsafe zone and distribute said plurality of members across the unsafe zone, each member being sized in length so that said individual is warned of entering the unsafe zone by contact between at least one of said members and said individual.

12. The system of claim 11 wherein said at least one base is arranged so that said members are randomly distributed over the unsafe zone.

13. The system of claim 11 wherein said at least one base and each member supported thereby are integrally formed as one-piece.

14. The system of claim 11 wherein each base and each member supported thereby are separable.

15. The system of claim 11 wherein at least two bases are provided and each base has the same peripheral outline.

16. The system of claim 15 wherein said bases comprise a plurality of varying outlines, each varying outline being shaped so that said bases substantially cover the unsafe zone when arranged together.

17. The system of claim 16 wherein the varying outlines include polygonal shapes.

18. The system of claim 17 wherein the polygonal shapes comprises squares, rectangles, triangles, trapezoids, or combinations thereof.

19. The system of claim 11 wherein each member has a generally rectangular shaped transverse cross section.

20. The system of claim 11 wherein a density of said plurality of members varies over the unsafe zone.

21. The system of claim 11 wherein lengths of said plurality of members vary over the unsafe zone.

22. The system of claim 11 wherein said at least one base is trimmed to fit an unsafe zone.

23. The system of claim 11 further comprising means for disabling machinery in or adjacent the unsafe zone upon contact by said individual with one of said at least one base and at least one member.

* * * * *

UNITED STATES PATENT AND TRADEMARK OFFICE

CERTIFICATE OF CORRECTION

PATENT NO. : 6,202,587 B1
DATED : March 20, 2001
INVENTOR(S) : Brian Stewart

It is certified that error appears in the above-identified patent and that said Letters Patent is hereby corrected as shown below:

Title page,
Item [73], the Assignee's name is Jervis B. Webb Company, not Jervis B. Webb International Company.

Signed and Sealed this

First Day of January, 2002

*Attest:*

*Attesting Officer*

JAMES E. ROGAN
*Director of the United States Patent and Trademark Office*